US009244436B2

(12) United States Patent
Hartzband et al.

(10) Patent No.: US 9,244,436 B2
(45) Date of Patent: Jan. 26, 2016

(54) TIMEPIECE

(71) Applicants: Paul Hartzband, Brookfield, CT (US); Bernard Barbu, St Cergues (FR)

(72) Inventors: Paul Hartzband, Brookfield, CT (US); Bernard Barbu, St Cergues (FR)

(73) Assignee: Paul Hartzband, Brookfield, CT (US)

( * ) Notice: Subject to any disclaimer, the term of this patent is extended or adjusted under 35 U.S.C. 154(b) by 0 days.

(21) Appl. No.: 14/351,228

(22) PCT Filed: Oct. 12, 2012

(86) PCT No.: PCT/EP2012/070297

§ 371 (c)(1),
(2) Date: Apr. 11, 2014

(87) PCT Pub. No.: WO2013/053906

PCT Pub. Date: Apr. 18, 2013

(65) Prior Publication Data

US 2014/0307532 A1 Oct. 16, 2014

(30) Foreign Application Priority Data

Oct. 15, 2011 (CH) ..... 1680/11
May 16, 2012 (CH) ..... 0698/12

(51) Int. Cl.
*G04B 19/00* (2006.01)
*G04B 19/02* (2006.01)
(Continued)

(52) U.S. Cl.
CPC ..... *G04B 45/0038* (2013.01); *A44C 25/00* (2013.01); *G04B 45/0007* (2013.01);
(Continued)

(58) Field of Classification Search
CPC ..... A44C 1/00; A44C 15/00; A44C 5/00; A44C 25/00; G04B 45/0007; G04B 45/0038; G04B 45/0046; G04B 45/0061; G04B 47/04; G04B 47/044
USPC ..... 368/76, 223, 228, 229, 285; 63/1.13, 3, 63/33
See application file for complete search history.

(56) References Cited

U.S. PATENT DOCUMENTS 3,148,500 A * 9/1964 Hayes ..... 368/80
3,665,700 A * 5/1972 Ditello ..... G04B 45/0046 368/131

(Continued)

FOREIGN PATENT DOCUMENTS

CH 319 646 A 2/1957
CH 339 107 A 6/1959

(Continued)

OTHER PUBLICATIONS

Thomas, Translation of DE4124775, pp. 5-6.*

(Continued)

*Primary Examiner* — Amy Cohen Johnson
*Assistant Examiner* — Daniel Wicklund
(74) *Attorney, Agent, or Firm* — Young & Thompson

(57) ABSTRACT

A timepiece includes a representation of a non-rectilinear object, the representation particularly including a movable element kinematically connected to a drive mechanism. The representation also includes at least one second movable element, the drive mechanism being arranged such that the movable elements each move, simultaneously and in synchronization, between a first and a second end position, and vice versa, the movable elements forming the representation at a first size and at a second size greater than the first, respectively, when the movable elements are in the first and second end positions thereof.

18 Claims, 4 Drawing Sheets

(51) Int. Cl.

| | |
|---|---|
| ***G04B 19/04*** | (2006.01) |
| ***G04B 19/30*** | (2006.01) |
| ***G04B 47/04*** | (2006.01) |
| ***A44C 5/00*** | (2006.01) |
| ***A44C 25/00*** | (2006.01) |
| ***G04B 45/00*** | (2006.01) |
| *A44C 15/00* | (2006.01) |

(52) U.S. Cl.

CPC ..... *G04B45/0023* (2013.01); *G04B 45/0046* (2013.01); *G04B 45/0061* (2013.01); *A44C 5/00* (2013.01); *A44C 15/00* (2013.01)

(56) References Cited

U.S. PATENT DOCUMENTS

| | | | | |
|---|---|---|---|---|
| 3,757,508 | A * | 9/1973 | Marklin | 368/76 |
| 3,952,500 | A * | 4/1976 | Tomura | 368/229 |
| 4,421,421 | A * | 12/1983 | Bradt | 368/229 |
| 4,601,585 | A * | 7/1986 | Farley | 368/80 |
| 4,712,924 | A * | 12/1987 | Agostini | 368/76 |
| 6,208,592 | B1 * | 3/2001 | Turner | 368/76 |
| 7,969,824 | B2 * | 6/2011 | Wiederrecht et al. | 368/220 |
| 8,379,491 | B2 * | 2/2013 | Bonhoff | 368/80 |
| 2003/0231555 | A1 * | 12/2003 | Sullivan | 368/223 |
| 2005/0232085 | A1 * | 10/2005 | Scheufele | 368/37 |

FOREIGN PATENT DOCUMENTS

| | | | |
|---|---|---|---|
| DE | 41 24 775 | A1 | 2/1992 |
| EP | 1 184 748 | A1 | 3/2002 |
| EP | 1 491 974 | A1 | 12/2004 |
| WO | WO 2006036660 | A2 * | 4/2006 |

OTHER PUBLICATIONS

International Search Report, dated Jan. 11, 2013, from corresponding PCT application.

* cited by examiner

TIMEPIECE

TECHNICAL FIELD

This invention relates to the field of horology. It relates more particularly to a timepiece comprising a depiction of a non-rectilinear object, said depiction being generally arranged on a dial, in order to be visible by a user. The depiction is in particular formed by a mobile element, kinematically connected to a driving mechanism able to be driven by a power source.

BACKGROUND OF THE INVENTION

It is well known that the field of horology and the world of machines share numerous technical features. It is thus know in some pieces, called "Jaquemart", to have a character having a movable arm driven by a driving mechanism wherein, when the hour changes, a striking system is activated. The movable arm is then actuated to give the impression that the sounds produced by the striking system result from blows struck by the character, striking a bell with his movable arm.

Much simpler timepieces are also known, in which the depiction of an object is simply fastened on a second hand, for example, to be driven around the movement continuously.

The present invention aims to propose a new type of animation that is very original. The invention proposes to depict a non-rectilinear object, i.e., to graphically depict a symbol or a real object in two dimensions. A straight segment is not considered to be a depiction of such an object.

BRIEF DESCRIPTION OF THE INVENTION

More specifically, the invention relates to a timepiece as mentioned in the first paragraph of this application, characterized in that said depiction is also formed by at least one second mobile element. Moreover, the driving mechanism is arranged so that the mobile elements each move, and synchronously with respect to one another, between first and second extreme positions. These mobile elements form said depiction according to a first size and a second size, larger than the first, when they are in their first or second extreme positions, respectively.

BRIEF DESCRIPTION OF THE DRAWINGS

Other details of the invention will appear more clearly upon reading the following description, done in reference to the appended drawing, in which.

DETAILED DESCRIPTION OF THE INVENTION

Figure 1:
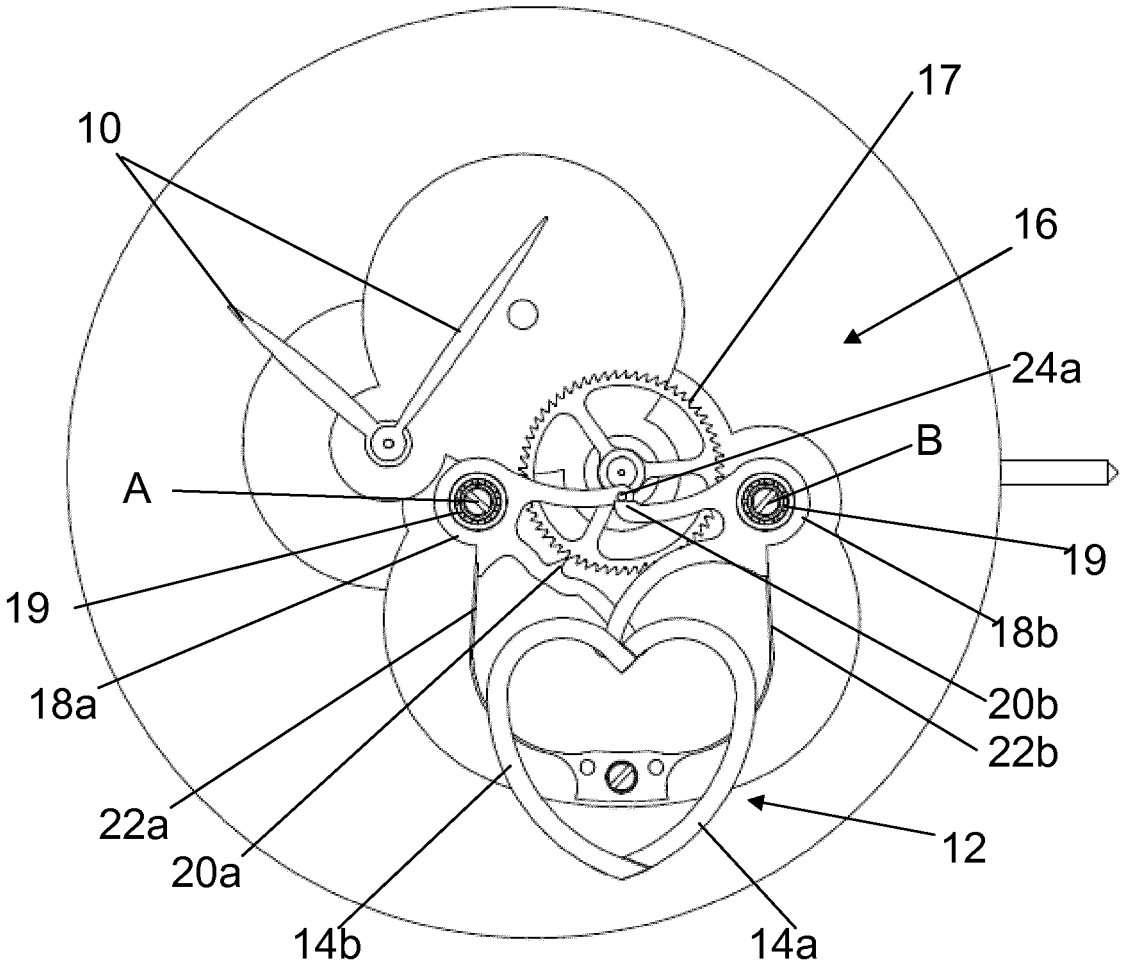
FIGS. 1, 2 and 3 are chronological views of the operation of a timepiece according to a preferred embodiment of the invention.

The following description describes one preferred embodiment, provided solely as a non-limiting example.

The figures show a diagrammatic depiction of a timepiece according to the invention. It comprises a horological movement, not shown in the figures, comprising a power source and a regulating system in order to display time information, for example by means of hands 10, moving above a dial that hides the movement.

The timepiece comprises a depiction of a non-rectilinear object. In the preferred embodiment, the object is a heart 12. This heart is formed by first and second mobile elements 14*a* and 14*b*, kinematically connected to a driving mechanism 16 that can be driven by the power source of the movement. Preferably, the mobile elements 14*a* and 14*b* are distinct and independent, i.e., they are not linked to each other by an articulated system, of the hinge type. As will be described hereafter, they can, however, be connected kinematically.

As illustrated in the example, the driving mechanism 16 comprises a cam 17, rotated by the movement. Typically, the driving mechanism 16 and the depiction are arranged on an independent module, i.e., on an independent frame, mounted on a basic movement. The cam 17 can then be fixed on a wheel of the basic movement, the pivot axis of which is extended at the module. Advantageously, it is also possible to provide a gear train at the module, so as to adapt the frequency of the pitches of the cam 17 and its speed of rotation. The possible presence of a gear train also makes it possible to arrange the cam 17 at a place chosen by the designer, without being constrained by the position of the axes of the wheels of the basic movement.

In the proposed example, the cam 17 assumes the form of a toothed wheel, fitted with an asymmetric toothing, with wolf toothing or saw toothing. As will be understood, according to the movements one wishes to obtain for the mobile elements 14*a* and 14*b*, the cam 17 may assume another shape. In particular, the profile of the teeth may be adapted, but a skilled person may also consider any type of protuberance.

The driving mechanism also comprises two levers 18*a* and 18*b*, pivoting in reference to axes A and B, respectively. To improve the pivoting of these levers 18*a* and 18*b*, both in terms of guiding and friction, they can be mounted on ball bearings 19. Each lever 18*a* and 18*b* is mounted integral with one of the mobile elements 14*a* and 14*b*. For example, a pin can be fixed on each lever so as to rigidly connect the levers 18*a* or 18*b* and the mobile element 14*a* or 14*b*. The mobile elements may receive an hour wheel and be assembled on the levers like the hands of a timepiece. Since the entire mechanism is intended to be arranged under the dial and the mobile elements 14*a* and 14*b* are intended to be arranged above the dial, the pins cross the dial through makeshift openings arranged in the dial. These openings can advantageously be hidden behind the mobile elements 14*a* and 14*b*, irrespective of their position.

The first lever 18*a* comprises a first feeler-spindle 20*a*, kept pressed against the cam 17 by a first spring 22*a*. The second lever 18*b* comprises a second feeler-spindle 20*b*, which is kept pressed against a banking 24*a* of the first lever 18*a* by a second spring 22*b*. Thus, while the first lever 18*a* is rotated directly by the displacements of the cam 17, the second lever 18*b* is rotated indirectly, via the first lever 18*a*. Thus, the movements of the two levers are perfectly synchronised, and setting differences in the springs 22*a* and 22*b* or in the cooperation of the feeler-spindles with the cam 17 do not disrupt the synchronism of the displacements of the levers 18*a* and 18*b*. It will be noted that the synchronisation of the displacements of the levers 18*a* and 18*b* can also be obtained by direct bearing of the levers on the cam 17, although this requires fine setting of the function. To reduce friction, the feeler-spindles can be made from ruby or coated with a material having a low friction coefficient with the metal of the cam or the lever.

Figure 2:
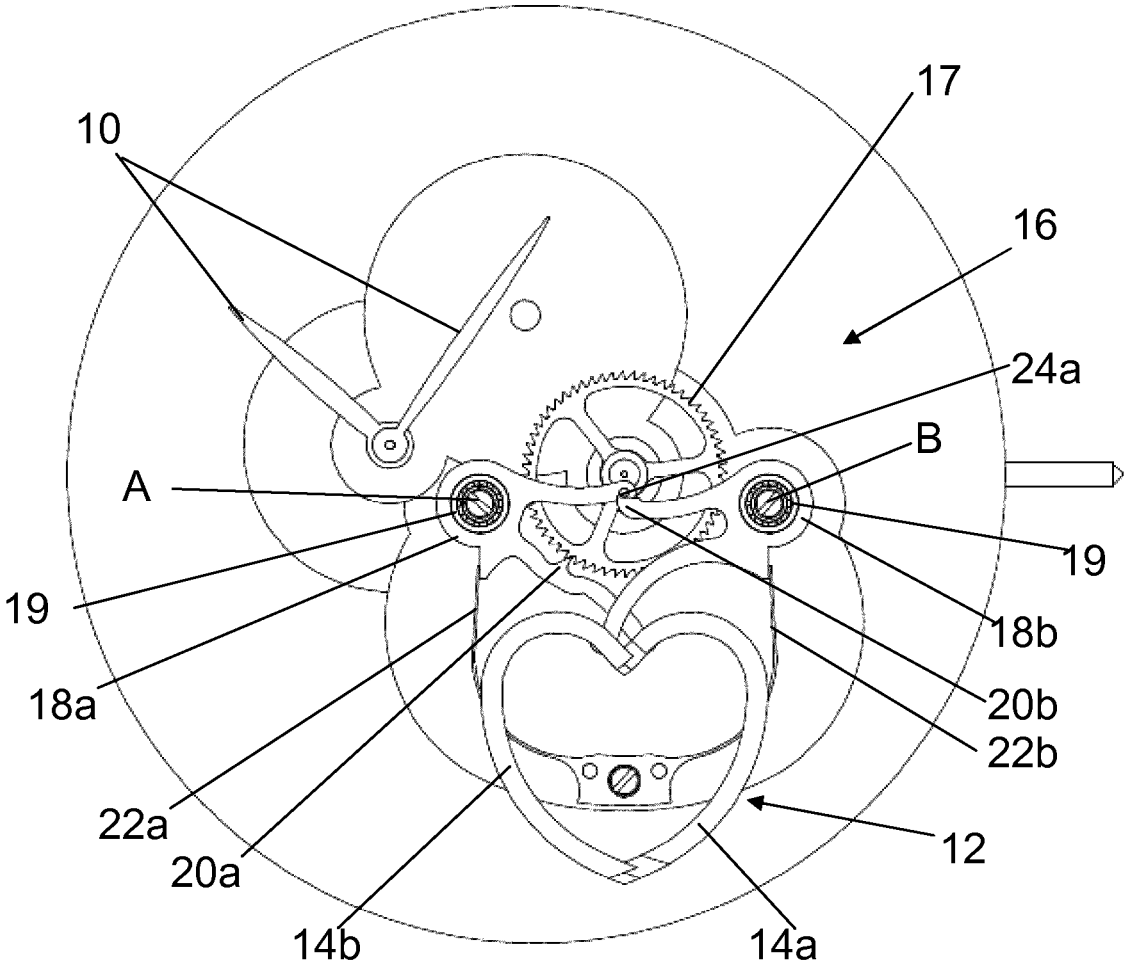
Figure 3:
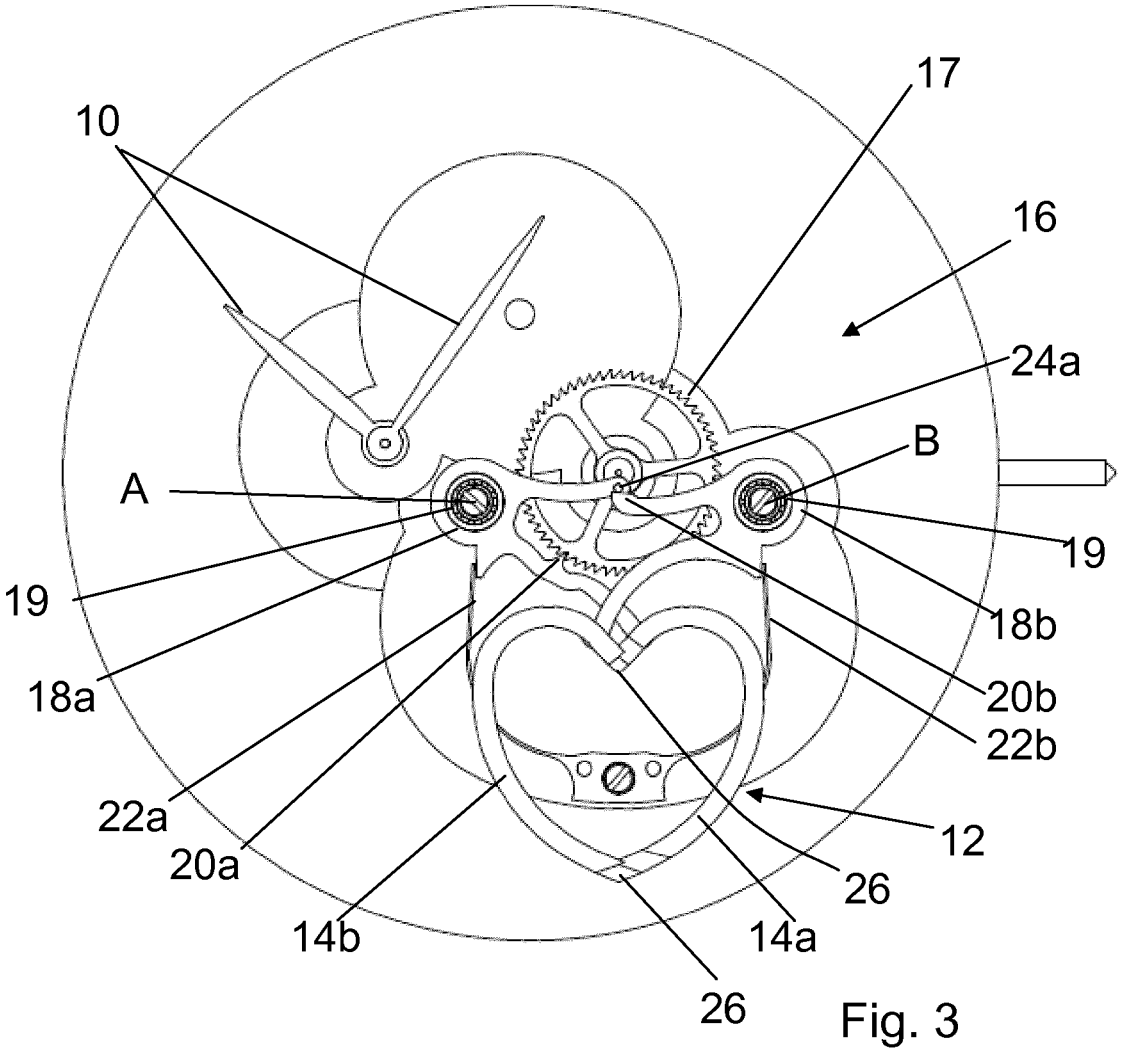

The mobile elements 14*a* and 14*b* therefore move following rotations defined in reference to the axes A and B, respectively, said axes advantageously being separate from one another. Owing to the fact that the mobile elements 14*a* and 14*b* are rigidly linked to the levers 18*a* and 18*b*, the first and second mobile elements each move simultaneously and synchronously with respect to one other, between first and second extreme positions and vice versa, i.e., following a retrograde movement. The first extreme position is shown in FIG. 1, while the second extreme position is shown in FIG. 3, FIG. 2 showing an intermediate position.

In the first extreme position, the mobile elements 14*a* and 14*b* form the depiction of the non-rectilinear objet, i.e. the heart 12, in a first size. In the second extreme position, the mobile elements 14*a* and 14*b* form the heart 12 in a second size, larger than the first one. The depiction obtained at the second size is a similarity by a factor k of the depiction obtained at the first size, k being determined by the design and construction of the timepiece. In the two respective sizes of the depiction of the object, the dimensions of the depiction advantageously vary in at least two directions. The invention therefore does not consist of simply depicting a larger or smaller straight segment, such a segment further not being considered to be a depiction of a non-rectilinear object, within the meaning of the present invention.

One could also consider synchronising the movements of the first and second mobile elements 14*a* and 14*b*, by connecting them by meshing, instead of a link by bearing of the second feeler-spindle. They could also be connected by a fork positioned at the end of one of the mobile elements, the other comprising a pin cooperating with the fork, the two elements being kept cooperating by a small spring that also limits the play between the mobile elements. It is thus possible to do away with the second spring 22*b* and reduce the impacts between the mobile elements 14*a* and 14*b*.

Advantageously, the driving mechanism 16 is arranged, owing to the shape of the cam 17, to give the illusion of a beating heart. Indeed, the levers 18*a* and 18*b* pivot gradually while the feeler-spindle 20*a* slides on an inclined portion of the cam 17, the first lever 18*a* driving the second lever 18*b*. Then, the levers 18*a* and 18*b* return to their initial position abruptly when the feeler-spindle 20*a* falls after having passed the tip of the teeth. In other words, the heart 12 gradually goes from its first size to its second size and suddenly returns to its first size.

In order to improve the illusion, the elements of the heart have a particular shape. For each element, each end of the element has a portion concentric to the axis of rotation around which the lever pivots. This is the case even for the central part of the heart.

Moreover, it is possible to provide that, when the heart 12 is depicted in its first size, the ends of the mobile elements 14*a* and 14*b* are sized and shaped in order to overlap while overlapping each other. This can be obtained either by adapting the thicknesses of the ends of the mobile elements, or by deforming at least one of said ends, so as to obtain an overlap.

In addition, the dial is fitted with portions 26 having an appearance that is similar in terms of colour and material to that of the mobile elements 14*a* and 14*b*. The portions 26 are hidden by the mobile elements 14*a* and 14*b* when said elements are in their first extreme position. When said elements move to their second extreme position, the portions 26 then become visible. Owing to the concentric shape in reference to the axes A and B, respectively, of the ends of the mobile elements 14*a* and 14*b*, the portions 26 may have the same size, i.e., the same width as the mobile elements 14*a* and 14*b* and, when the portions 26 are visible, they form, with the mobile elements 14*a* and 14*b*, the heart 12 in its second size. In that case, as shown in FIG. 3, the portions 26 "extend", even if they are in a different plane, the mobile elements 14*a* and 14*b*.

In one preferred embodiment, the combination of the specific shape of the heart 12, a suitable shape of the cam 17, a suitable driving rhythm, make it possible to give the illusion of a heartbeat, as sometimes shown in a stylised manner.

In the invention described above, the depiction is of a heart, but other non-rectilinear objects may also be chosen. It is thus possible to depict a star, a mouth or various other shapes that can be depicted by a limited number of mobile elements. It is in fact possible to consider combining up to 4 or 6 mobile elements. Moreover, mobile elements can also be combined with static elements that are continuously visible so as to depict the chosen object. It will be noted that preferably, the mobile elements are designed to rotate around separate distinct axes, at least around a plurality of axes.

The mechanism described above is compatible with a mechanical or quartz regulating mechanism. A driving mechanism 16 as proposed above can be adapted to an electro-mechanical embodiment. An independent driving mechanism for each mobile element is also possible, the driving systems being synchronised by a control electronic circuit.

A skilled person can also provide a control system to activate or stop the driving mechanism 16 and the movements of the depiction. In a mechanical or electromechanical timepiece, the control system can act on a coupling mechanism, like those used in chronograph mechanisms, located in the kinematic chain between the movement and the cam 17. The uncoupling of the coupling system stops the rotation of the cam 17. In an electronic timepiece, the control system may act directly on the electronic control circuit.

The control system may be a manual control system, such as a push-piece. But an automatic control system is also possible, as proposed in alarms or alarm clocks. At a programmed time, the control system then automatically activates the driving mechanism 16 and the heart or the chosen depiction moves from one size to the other. In such a mechanical embodiment, the driving mechanism can be associated with its own power source, possibly located in the module. However, it is also possible to consider, based on the technical teaching known from "grande sonnerie" mechanisms, to take the energy for driving the depiction from the movement barrel. The stop of the driving occurs either after a predetermined time or when the specific barrel has been unloaded. A skilled person will be able to use his general knowledge in the field of striking mechanisms to implement this embodiment of the invention. For such an embodiment of the electronic or electromechanical type, the electronic circuit can be programmed so as to react to an actuation of a manual control organ or to define the duration and time when the depiction is moved.

It is optionally possible to provide that the mobile elements are driven directly by the movements of an oscillating mass, like those used in automatic winding mechanisms, the oscillating mass being secured in rotation or kinematically connected to the cam, to drive the mobile elements based on the movements of the wearer of the timepiece.

Figure 4:
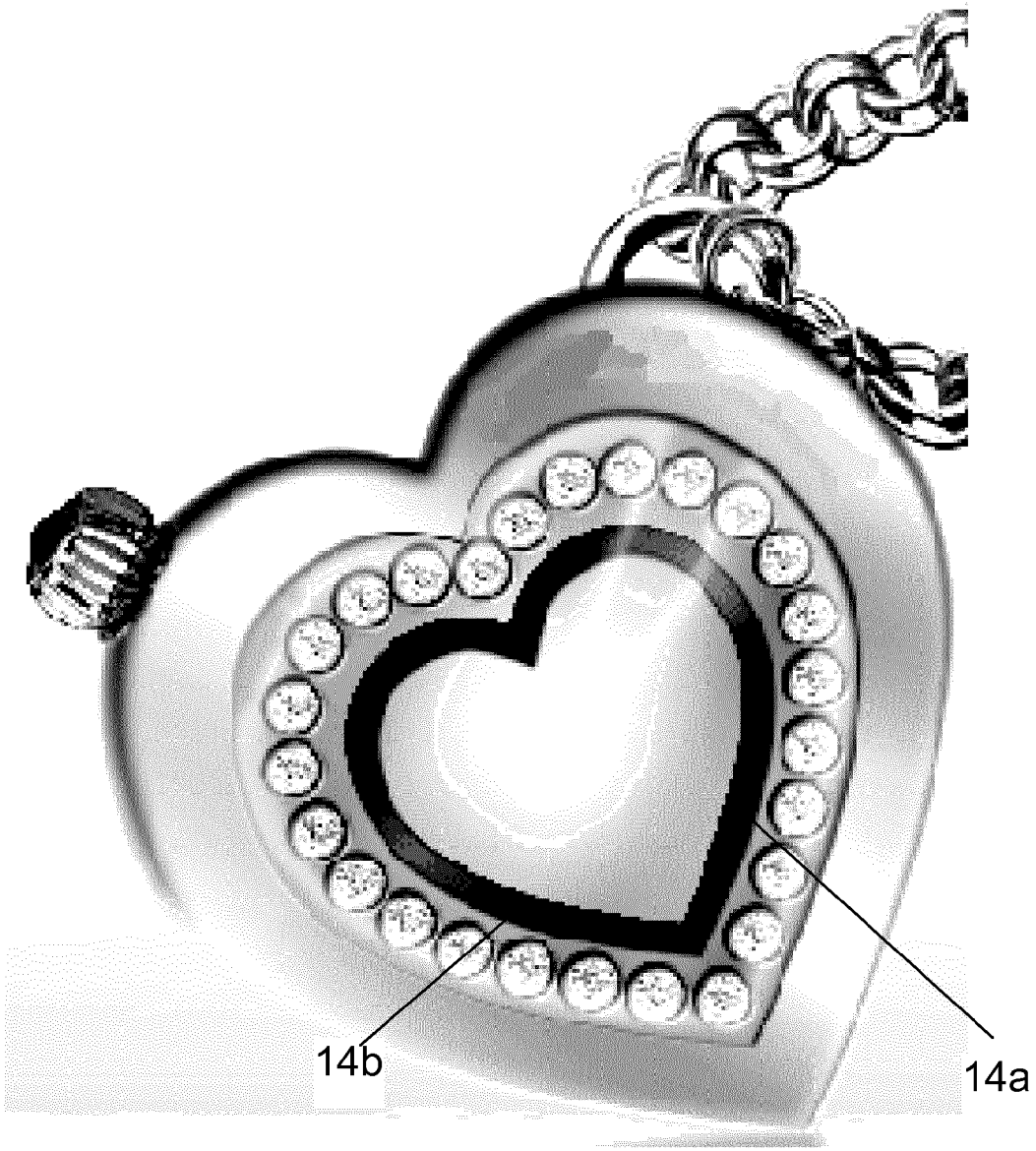
FIG. 4 shows another embodiment of the invention.

A timepiece according to the invention is applicable to a bracelet watch. It may also be applicable to any type of jewellery item, of the jewel type (FIG. 4), such as a necklace or other pendant, or a pin. Although in this application the mechanism may not provide the time and may in particular lack means for displaying time information, it may nevertheless legitimately be included in the scope of the term "timepiece" used in the claims, given that it uses systems used in horology.

The invention claimed is:

1. A timepiece comprising:

a timepiece movement with a power source;

a driving mechanism (16) rotated by the timepiece movement; and a first mobile element (14*a*) and at least one second mobile element (14*b*) that together form a depiction of a non-rectilinear object, the first mobile element being kinematically connected to the driving mechanism (16) such that said first mobile element and said at least one second mobile element each move simultaneously and synchronously with respect to one another, between i) a first extreme position and ii) a second extreme position and vice versa, wherein i) in said first extreme position, said first mobile element and said at least one second mobile element form said depiction with a first size, and ii) in said second extreme position, said first mobile element and said at least one second mobile element form a second size, the second size being larger than the first size, and wherein said first and said at least one second mobile elements are arranged so as to move between the first and second extreme positions and vice versa in a retrograde movement.

2. The timepiece of claim 1, further comprising a dial, said first mobile element and said at least one second mobile element being arranged above the dial with the depiction being visible to a user, and the timepiece movement being arranged under the dial.

3. The timepiece according to claim 2, wherein the depiction depicts a heart.

4. The timepiece of claim 1, further comprising a dial, said first mobile element and said at least one second mobile element being arranged above the dial, and the timepiece movement being arranged under the dial, wherein i) in said first extreme position, portions of said dial are hidden by said first mobile element and said at least one second mobile element portions of the dial.

5. The timepiece of claim 1, further comprising a dial, said first mobile element and said at least one second mobile element being arranged above the dial, and the timepiece movement being arranged under the dial, wherein i) in said first extreme position, portions of said dial are hidden by said first mobile element and said at least one second mobile element, and ii) in said second extreme position, said portions are visible, and in said second extreme position, said portions forming, with said first and said at least one second mobile elements, said depiction in second size.

6. The timepiece of claim 1, further comprising at least one lever, wherein the driving mechanism comprises a cam driven by the power source such that the cam has movement, and the at least one lever is moved by the movement of the cam.

7. The timepiece of claim 6, further comprising a first lever and a second lever, wherein the driving mechanism comprises a cam driven by the power source such that the cam has movement, and each of the levers is moved by the movement of the cam.

8. The timepiece of claim 7, further comprising first and second springs, first and second feeler-spindles, and a banking situated on the first lever, wherein the first lever comprises the first feeler-spindle, the first feeler-spindle being kept pressed against the cam by the first spring, and the second lever comprises the second feeler-spindle, the second feeler-spindle being kept pressed against the banking situated on the first lever, by the second spring.

9. The timepiece according to claim 8, further comprising ball bearings, wherein said levers are pivoted on the ball bearings.

10. The timepiece according to claim 7, further comprising ball bearings, wherein said first and second levers are pivoted on ball bearings.

11. The timepiece of claim 6, further comprising a kinematic chain connecting the movement to the cam, a coupling mechanism inserted in the kinematic chain, and a control system that activates and stops the driving mechanism, wherein the control system is arranged to control the coupling mechanism inserted in the kinematic chain connecting the movement to the cam.

12. The timepiece of claim 6, further comprising a lever for each of said first mobile element and said at least one second mobile element, and wherein the driving mechanism comprises a cam driven by the power source such that the cam has movement, and each lever is moved by the movement of the cam.

13. The timepiece according to claim 1, wherein the depiction depicts a heart of the first size in each of a first and second dimension in the first position and of the second size in each of the first and second dimensions in the second position.

14. The timepiece of claim 13, further comprising plural levers, wherein each of said first mobile element and said at least one second mobile element is rigidly connected to a respective one of said levers, each lever pivoting around an axis of rotation, and wherein each end of each of said first mobile element and said at least one second mobile element presents a portion concentric to the axis of rotation in reference of which the respective one of the levers pivots.

15. The timepiece of claim 1, further comprising a control system that activates and stops the driving mechanism.

16. The timepiece of claim 1, wherein i) in said first extreme position, said first mobile element and said at least one second mobile element form said depiction with a first size with a first dimension in a first direction and a second dimension in a second direction, and ii) in said second extreme position, said first mobile element and said at least one second mobile element form a second size with a third dimension in the first direction and a fourth dimension in the second direction, the third and fourth dimensions being respectively larger than the first and second dimension by a factor k.

17. The timepiece according to claim 1, wherein the depiction depicts a heart of the first size in each of a first and second dimension in the first position and of the second size in each of the first and second dimensions in the second position, the second position being respectively larger than the first position by a factor k in each of the first and second directions.

18. A jewellery item that includes the timepiece of claim 1.

* * * * *